US007597205B2

(12) United States Patent
Shepard-Vagedes et al.

(10) Patent No.: US 7,597,205 B2
(45) Date of Patent: Oct. 6, 2009

(54) COLLAPSIBLE FOLDABLE CLOTHES RACK

(76) Inventors: Gina Shepard-Vagedes, 677 Sunnybrook Dr., Florence, KY (US) 41042; Michael Vagedes, 677 Sunnybrook Dr., Florence, KY (US) 41042

( * ) Notice: Subject to any disclaimer, the term of this patent is extended or adjusted under 35 U.S.C. 154(b) by 40 days.

(21) Appl. No.: 11/535,527

(22) Filed: Sep. 27, 2006

(65) Prior Publication Data

US 2008/0083687 A1 Apr. 10, 2008

(51) Int. Cl.
*A47B 47/00* (2006.01)

(52) U.S. Cl. ..... 211/200; 211/189

(58) Field of Classification Search ..... 211/189, 211/182, 195, 200, 202; 248/165, 163.1, 248/164, 432, 440, 169.1, 171, 439; 108/145
See application file for complete search history.

(56) References Cited

U.S. PATENT DOCUMENTS 1,209,679 A * 12/1916 Decker ..... 5/116
5,351,843 A * 10/1994 Wichman et al. ..... 211/195
6,427,858 B2 * 8/2002 Sabounjian ..... 211/202
6,932,227 B1 * 8/2005 Glenn ..... 211/202
7,168,580 B2 * 1/2007 Larimer et al. ..... 211/200
2004/0173553 A1 * 9/2004 Li ..... 211/202

* cited by examiner

*Primary Examiner*—Katherine W Mitchell
*Assistant Examiner*—Candace L. Bradford
(74) *Attorney, Agent, or Firm*—Wood, Herron & Evans, L.L.P.

(57) ABSTRACT

A collapsible foldable rack includes left and right scissors-type frames with dowel rods extending between the scissors-type frames. The dowel rods are attached to inner arms of the scissors-type frame by brackets that allow the rods to rotate relative to the frame. The brackets on one side of the frame allow the rods to rotate in one direction, whereas the brackets on the opposite frame member allow the rods to rotate in the opposite direction. The brackets also space the rods relative to each other to prevent adjacent rods from interfering with each other when the structure is folded. The device both collapses into a rectangular structure and then folds upon itself to provide a very compact structure for storage and reduce freight costs.

7 Claims, 4 Drawing Sheets

COLLAPSIBLE FOLDABLE CLOTHES RACK

BACKGROUND OF THE INVENTION

Collapsible clothes-drying racks are formed from a pair of scissors type frame members with dowel rods extending between the frame members. These collapse into a rectangular structure, which can be stored. Even in the collapsed state, these racks take up a great deal of space.

Therefore, it is desirable to provide such a rack that is both collapsible and foldable into a much smaller article. This would reduce the amount of shelf space required to display these items at stores and also would make them easier to store at home. In addition, the present invention reduces shipping space cutting freight costs.

SUMMARY OF THE INVENTION

The present invention is premised on the realization that a collapsible foldable rack can be formed by attaching the dowel rods to the scissors frame members with hinged brackets. These brackets are designed to enable the collapsed rack, specifically, the collapsed scissor frame members, to be folded together. The brackets space the individual dowel rods allowing adjacent rods to lie flat on top of each other.

The objects and advantages of the present invention will be further appreciated in light of the following detailed description and drawings, in which:

DETAILED DESCRIPTION OF THE INVENTION

Figure 1:
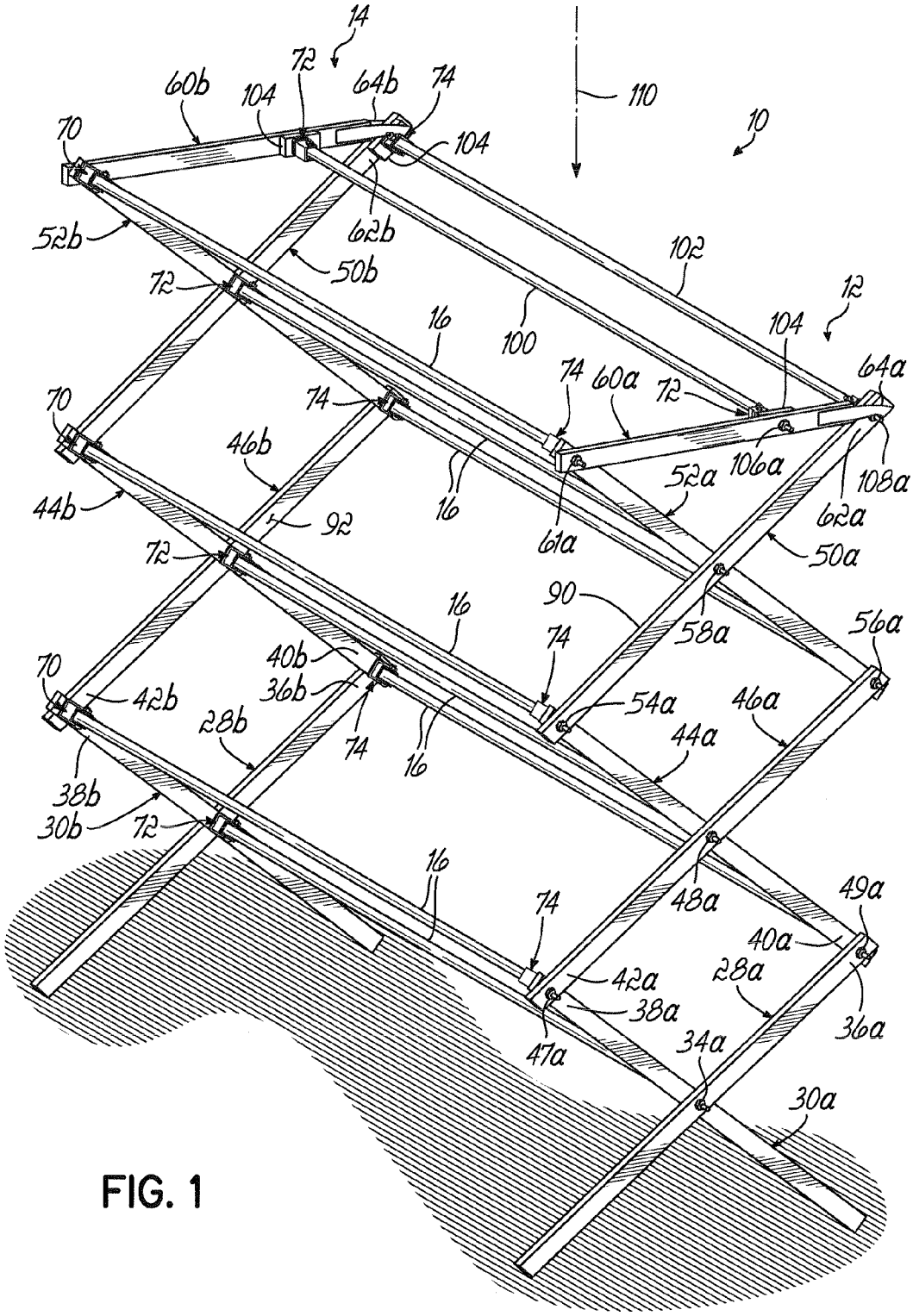
FIG. 1 is a perspective view of the erected assembly.

As shown in FIG. 1, the present invention is a collapsible foldable drying rack 10, which includes opposed scissors frame members 12 and 14, which are connected to each other by a plurality of dowel rods 16.

The scissors frame members 12 and 14 are formed from a plurality of arms, which are connected at their midpoints and their distal ends. More particularly, as shown with frame member 12, first and second arms 28*a* and 30*b* are rotatably connected at a midpoint by a connector 34*a* such as a nut and bolt, as shown, or a rivet or pin. The distal ends 36*a* and 38*a* of arms 28*a* and 30*a* respectively are then connected to the lower ends 40*a* and 42*a* of arms 44*a* and 46*a* by connectors 47*a* and 49*a*. Arms 44*a* and 46*a* are, in turn, rotatably connected at their midpoint by a connector 48*a*, and rotatably connected to frame members 50*a* and 52*a* by connectors 54*a* and 56*a*.

Arms 50*a* and 52*a* are connected at their midpoint by connector 58*a*. Arm 52*a* is connected to a horizontal top arm 60*a* by a fastener 64*a*. Arm 60*a* attaches to the upper end 62*a* of arm 50*a* by a fastener 64*a*.

In this embodiment, the fastener 64*a* is simply a strap. Other types of removable fasteners or latches can be used. The strap or latch when connected to the upper end 62*a* of arm 50*a* holds the frame in an extended position, as shown in FIG. 1.

Figure 3:
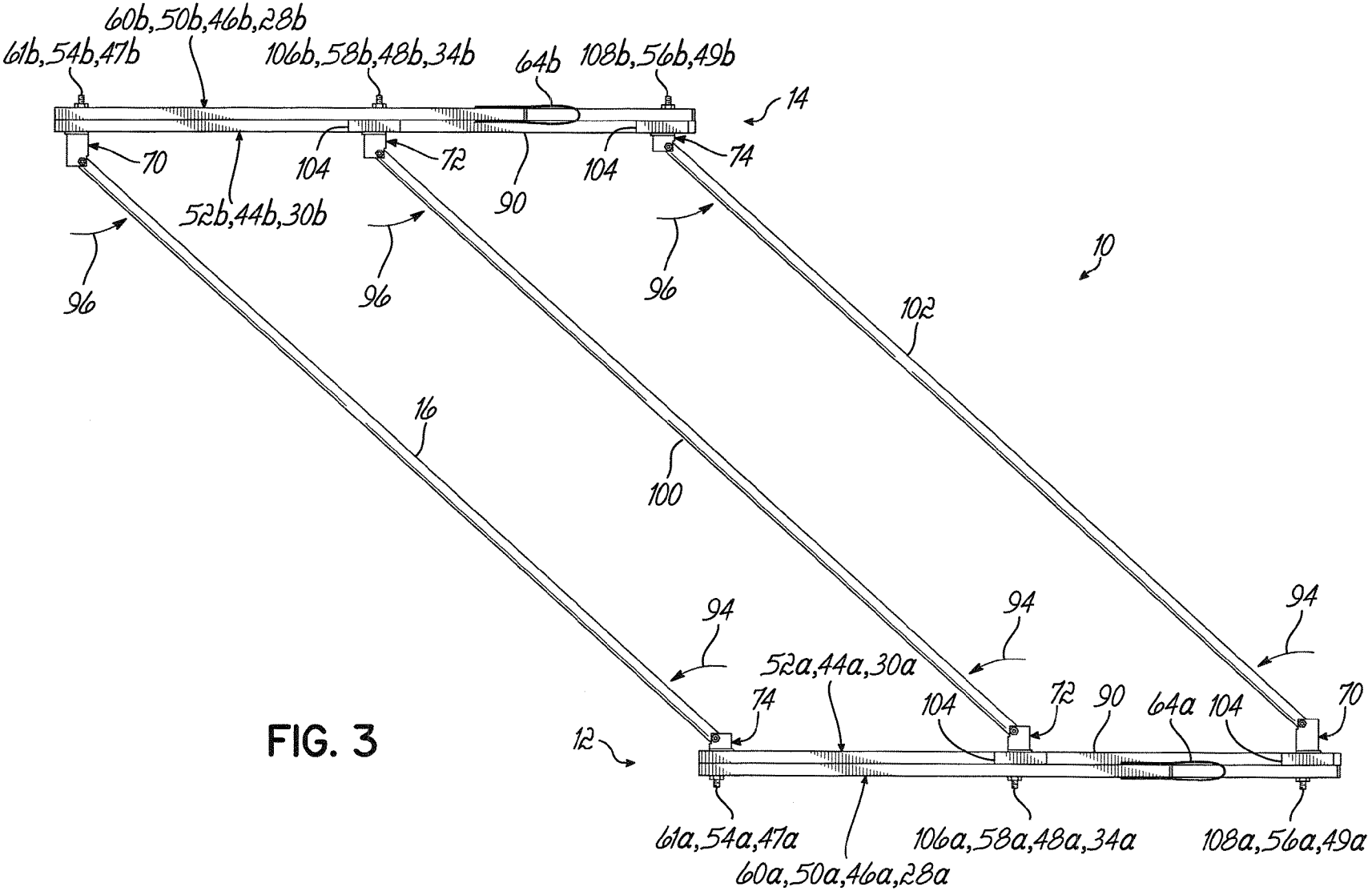
FIG. 3 is a top view of the invention shown in FIG. 2, collapsing in a horizontal plane.

Likewise, frame member 14 includes first and second arms 28*b* and 30*b*, which are rotatably connected by a connector 34*b*, such as a nut and bolt or rivet shown in FIG. 3. The upper ends 36*b* and 38*b* of arms 28*b* and 30*b* are then connected to the lower ends 40*b* and 42*b* of arms 44*b* and 46*b*. Arms 44*b* and 46*b* are, in turn, rotatably connected at their midpoint by a connector 48*b* shown in FIG. 3 and rotatably connected to arms 50*b* and 52*b*.

Finally, the arms 50*b* and 52*b* are connected at their midpoint by a connector 58*b* also shown in FIG. 3. Arms 52*b* is connected to a horizontal top arm 60*b* by connector 61*b*. Arm 60*b* attaches to the upper end 62*b* of arm 50*b*. As shown, this connection is made with a strap or latch 64*b*, which attaches to the upper end 62*b* of arm 50*b*.

Figure 8:
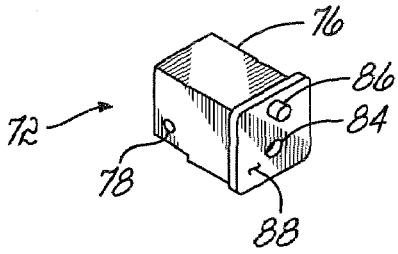
FIG. 8 is a rear perspective view of the bracket shown in FIG. 6.

Opposite ends of the dowel rods 16 are attached to the scissors frame 12 and 14 by three separate sized brackets, a large bracket 70, a medium bracket 72, and a small bracket 74. As shown in FIG. 8, the brackets 70, 72 and 74 have a generally rectangular frame 76 with holes 78 adapted to allow a pin not shown to pass through and attach a dowel rod (or square rod if desired) 16 to the bracket and permit the rod to rotate into an open portion 80 of the respective bracket. The brackets can be any shape as long as they allow the rod to rotate. The brackets are simply attached to the scissors frame with one of the fasteners that hold the arms of the scissor frame member together. As shown, the screw extends through hole 84 and through overlapping arms. In order to keep the bracket from rotating itself relative to the frame, the surface of the arm includes a small hole not shown. A boss 86 in the back side 88 of the brackets 70-74 locate in the hole. The fastener, in combination with the boss, prevents the brackets from rotating. This can also be accomplished using an extra pin or by counter sinking the bracket into the arm.

As can be seen, the brackets 70, 72, and 74 are located on inside surfaces 90 and 92 of arms 30*a*, 44*a*, and 52*a* of frame member 12, and 30*b*, 44*b* and 52*b* on frame member 14. The orientation of the brackets on opposite frame members 12 and 14 is reversed to allow rotation of the dowel rods in opposite directions. Thus, as shown in FIG. 3, the dowel rods attached to frame member 12 rotate in the direction of arrows 94, and the dowel rods in right frame member 14 rotate in the direction of arrows 96.

Figure 4:
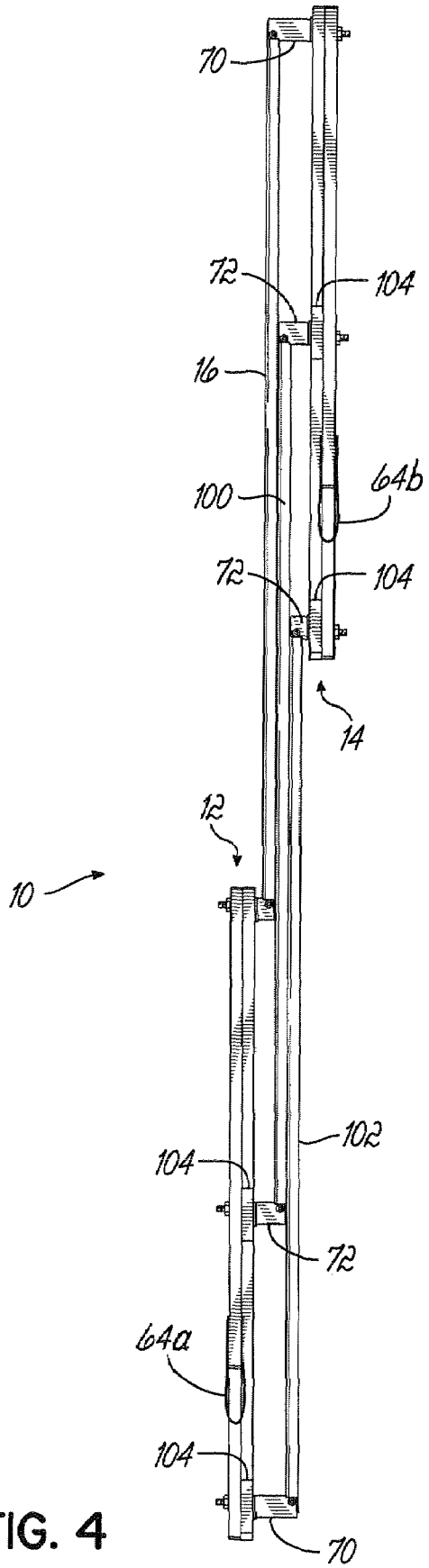
FIG. 4 is a top view of the rack fully collapsed.
Figure 5:
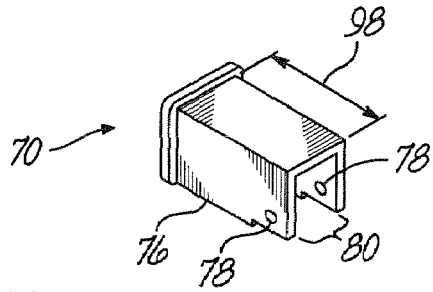
FIG. 5 is a perspective view of the bracket used in the present invention.
Figure 6:
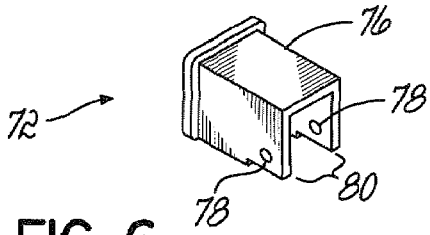
FIG. 6 is a perspective view of a medium-sized bracket used in the present invention.
Figure 7:
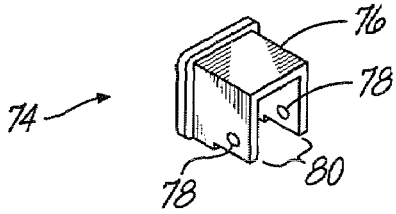
FIG. 7 is a perspective view of a small bracket used in the present invention.

As can be seen in FIG. 3, the large brackets 70 have a length 98 equal to the length of the medium-sized brackets 72, plus at least the diameter of the dowel rod. Likewise, the medium-sized brackets 72 have a length equal to the length of the small bracket 74, plus at least the diameter of the dowel rod, so that when the frame members 12 and 14 fold over, as shown in FIG. 4, adjacent dowel rods will rest on each other. Thus, the length of the brackets prevents interference of the adjacent dowel rods as the rack is folded.

As shown in FIGS. 1 and 3, the brackets 70, 72 and 74 on frame 12 are complementary to the brackets on the opposite frame 14. In other words, if a large bracket 70 is used on one end of a dowel, the small bracket 74 will be used on the opposite end of that dowel. If a medium-sized bracket 72 is used on one end of a dowel, a medium-sized bracket 72 will also be used on the opposite end of the dowel. Thus, the total length of each of the dowels and their attached brackets is the same.

Dowel 100 extends between horizontal arms 60*a* and 60*b* and dowel 102 extends between arms 50*a* and 50*b*. In order to provide the required length, spacers 104 equal to the width of one frame member are fixed between the frame member 50*a*, 50*b*, and 60*a*, 60*b* and the respective bracket. This is required because all of the other dowels attach to inner arms of frame members 12 and 14, whereas the dowel rods 100 and 102 attach to the outer arms of frame members. Alternately larger brackets can be used in place of the brackets and spacer.

Figure 2:
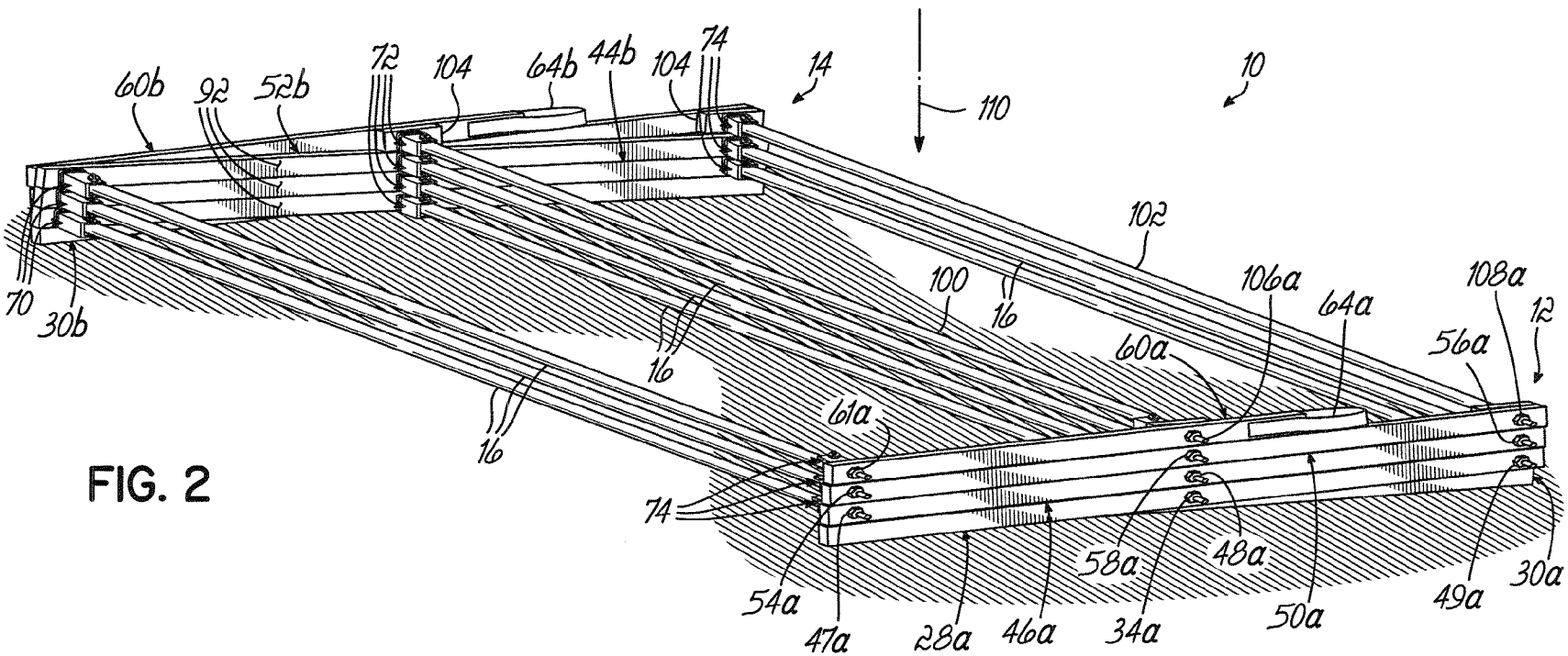
FIG. 2 is a perspective view of the vertically collapsed assembly.

Thus, rack 10 folds in two directions. It will collapse downwardly as shown by arrow 110, and will fold 90 degrees as shown by arrows 94 and 96, into the structure shown in FIG. 4. To assemble the device, one simple unfolds the frame member in the direction opposite arrows 94 and 96 to provide the structure shown in FIG. 2. This is then lifted up and straps 64*a* and 64*b* are positioned over the ends 62*a* and 62*b* of frame members 50*a* and 50*b*, holding the structure in position.

Thus, the present invention provides a rack which both collapses and folds, reducing its overall size, reducing shipping space using less display space at a store and less storage space at home.

This has been a description of the present invention along with the preferred method of practicing the present invention. However, the invention itself should only be defined by the appended claims wherein

We claim:

1. A collapsible foldable rack comprising first and second scissor frames, said scissor frames having a collapsed position and an extended position, each said scissor frame comprising a first and second scissor frame member;

a plurality of dowel rods extended between said first and scissor frames wherein ends of said dowel rods are spaced a distance from said scissor frames effective to permit said rack to fold on itself when said scissor frames are in said collapsed position whereby said dowel rods are foldable onto said scissor frames;

a series of different sized brackets connecting said dowel rods to said scissor frames, wherein one of said brackets is fixed to each end of each dowel rod; and wherein said size of said respective brackets permit said dowel rods to fold relative to said scissor frames and lie parallel to said scissor frames with said brackets attached to said scissor frames and said dowel rods fixed to said brackets.

2. The rack claimed in claim 1 wherein each bracket comprises a generally rectangular frame having three walls and an open portion permitting folding of a dowel rod connected to said bracket.

3. The rack claimed in claim 1 further comprising an attachment mechanism to hold said scissor frames in an extended position.

4. The rack claimed in claim 1 wherein each said bracket includes a boss fixed in a hole in an arm of said scissors frames preventing rotation of said bracket relative to said arm.

5. The rack claimed in claim 1 wherein all of said dowel rods with brackets attached to ends of said dowel rods have equal lengths.

6. The collapsible foldable rack claimed in claim 1 wherein each of said first and second scissor frames includes at least four interconnected arms and wherein said arms are parallel to each other when said scissor frames are in a collapsed position.

7. The collapsible foldable rack claimed in claim 6 wherein said dowel rods and said arms are generally parallel to each other when said scissor frames are in said collapsed position and said dowel rods are folded upon said scissor frames.

* * * * *

UNITED STATES PATENT AND TRADEMARK OFFICE

CERTIFICATE OF CORRECTION

PATENT NO. : 7,597,205 B2
APPLICATION NO. : 11/535527
DATED : October 6, 2009
INVENTOR(S) : Gina Shepard Vagedes et al.

It is certified that error appears in the above-identified patent and that said Letters Patent is hereby corrected as shown below:

Col. 3, lines 35-36, Claim 1, "said first and scissor frames" should read --said first and second scissor frames--.

Signed and Sealed this

Twenty-third Day of March, 2010

David J. Kappos

David J. Kappos
*Director of the United States Patent and Trademark Office*